United States Patent [19]

Nelson

[11] 4,262,754

[45] Apr. 21, 1981

[54] ROTARY DRILLING DEVICE WITH PIVOTING DRILL HEAD ASSEMBLY

[75] Inventor: Ivan L. Nelson, Osceola, Iowa

[73] Assignee: Southern Iowa Manufacturing Co., Osceola, Iowa

[21] Appl. No.: 39,310

[22] Filed: May 15, 1979

[51] Int. Cl.[3] ..... E21B 19/00

[52] U.S. Cl. ..... 173/43; 24/263 DA; 292/201

[58] Field of Search ..... 173/28, 42, 43, 44; 24/263 DA; 248/647; 292/201

[56] References Cited

U.S. PATENT DOCUMENTS

| | | | |
|---|---|---|---|
| 2,792,198 | 5/1957 | Braun | 173/43 X |
| 2,919,899 | 1/1960 | Hitchcock | 173/42 X |
| 3,199,153 | 8/1965 | Weinstein | 292/201 X |
| 3,302,735 | 2/1967 | Klem et al. | 173/43 |
| 3,805,693 | 4/1974 | Neitzel et al. | 292/201 X |
| 3,835,940 | 9/1974 | Winter, Jr. | 173/28 X |
| 3,915,491 | 10/1975 | Montgomery | 292/201 X |

*Primary Examiner*—Wm. Carter Reynolds

*Attorney, Agent, or Firm*—G. Brian Pingel; Rudolph L. Lowell

[57] ABSTRACT

In a rotary drilling device for powering a drill string into subterranean strata and having a vertically alignable drill mast, a drill head assembly for applying rotational movement to the drill string, elevational means on which the head assembly is mounted on said mast for vertical movement thereon, and with the head assembly including a support housing for a rotary drive unit pivotally movable from an operating position in alignment with the drill string to a pivoted position out of such alignment. The drill head assembly further includes a latch assembly for normally maintaining the support housing in its operating position when in a closed condition and to release the support housing when in an open condition, an extensible and retractible member for actuating the latch means from a closed condition to an open condition, for moving the support housing into its pivoted position and for returning the support housing to the operating position, and spring members for retaining the latch assembly in an open condition during return movement of the support housing to the operating position.

6 Claims, 6 Drawing Figures

ROTARY DRILLING DEVICE WITH PIVOTING DRILL HEAD ASSEMBLY

BACKGROUND OF THE INVENTION

1. Field of the Invention

The present invention relates in general to devices for powering a drill string into subterranean strata and more specifically to such devices that have a pivoting drill head assembly.

2. Description of the Prior Art

Soil drilling devices are typically mounted on a trailer or the bed of a truck to provide for their ready portability from one working location to another. Also, they include a vertically alignable mast assembly that may be pivotable into a horizontal position for travel of the device between locations. A drill head is normally mounted on the mast assembly for vertical movement thereon and includes a rotary power drive for applying rotational force on the end of a drill string being driven into the ground.

To begin a drilling operation with such drilling devices, the drill head is moved to the top of the mast, and a drill rod is placed in a rod handling means located at the bottom of the mast and is then attached to the drill head. A wide variety of methods have been employed in the past for placing the drill rod into the rod handling means, but it has been found that one of the simplest procedures for accomplishing this operation is by means of a hoist winch having hoist sheaves placed at the top of the mast. However, because of the normal position of a drill head on the mast interposed between the hoist sheaves and the rod handling means, it presents an obstruction to easy handling of the drill rod.

There have been several solutions proposed for moving the drill head out of an obstructing position when it is desired to add or remove the string rod with the hoist winch. The most practical method for moving the drill head from an obstructing position is to pivotally mount the drill head on the drill mast so that when desired, the drill head may be pivoted to one side of the mast into an unobstructing position as described in U.S. Pat. No. 3,835,940 issued Sept. 17, 1974. During normal operation of the device of such patent, a latch assembly is employed to hold the drill head from pivoting out of position.

On drilling devices having short mast sections, unlatching and pivoting of the drill head can be accomplished manually by a worker standing on the ground. However, on drilling devices having mast sections over ten feet in length, it is necessary for the worker to climb the mast for unlatching and pivoting operation or else separate hydraulic cylinders are employed for the tasks of unlatching the drill head and then pivotally moving the head out of an operating position. It has been found that for efficient drilling operation, manual movement of the drill head is highly undesirable and yet the use of two separate hydraulic cylinders is unduly expensive. Accordingly, the present invention provides a rotary drilling device having a single power means for automatically unlatching the drill head for pivotal movement thereof out of an operating position, for returning the drill head back into the operating position and relatching of the drill head.

SUMMARY OF THE INVENTION

The present invention provides a rotary drilling device for powering a drill string into subterranean strata and having a supporting main frame, a vertically alignable drill mast mounted from the main frame, a drill string handling member disposed at a lower end of the drill mast, winch means disposed at an upper end of the mast for raising and lowering the drill string, a drill head assembly with a support means and a rotary drive unit mounted therein for applying rotational movement to the drill string, and elevational means on which the drill head assembly is mounted on the mast for vertical movement thereon, with the support housing being pivotally movable with respect to the drill mast to move from an operating position in alignment with the rod handling means into a pivoted position out of such alignment.

To provide for pivoting movement of the support housing with respect to the drill mast, the head assembly further includes a hinge plate connected to the elevational means and the support means has at least two opposite side walls and a connecting wall therebetween. Coacting hinge means are located on the hinge plate and one of said support means side walls to pivotally connect the support means with the hinge plate, and coacting latch means on the hinge plate and the other of said support means side walls normally maintain the support means in said operating position when in a closed condition and to release the support means when in an open condition.

A power means is included in the head assembly for actuating the latch means from a closed condition to an open condition, for pivoting the support means into the pivoted position, and returning the support means to said operating position while said latch means is held in an open condition by a spring biased retaining means.

DESCRIPTION OF THE PREFERRED EMBODIMENT

Figure 1:
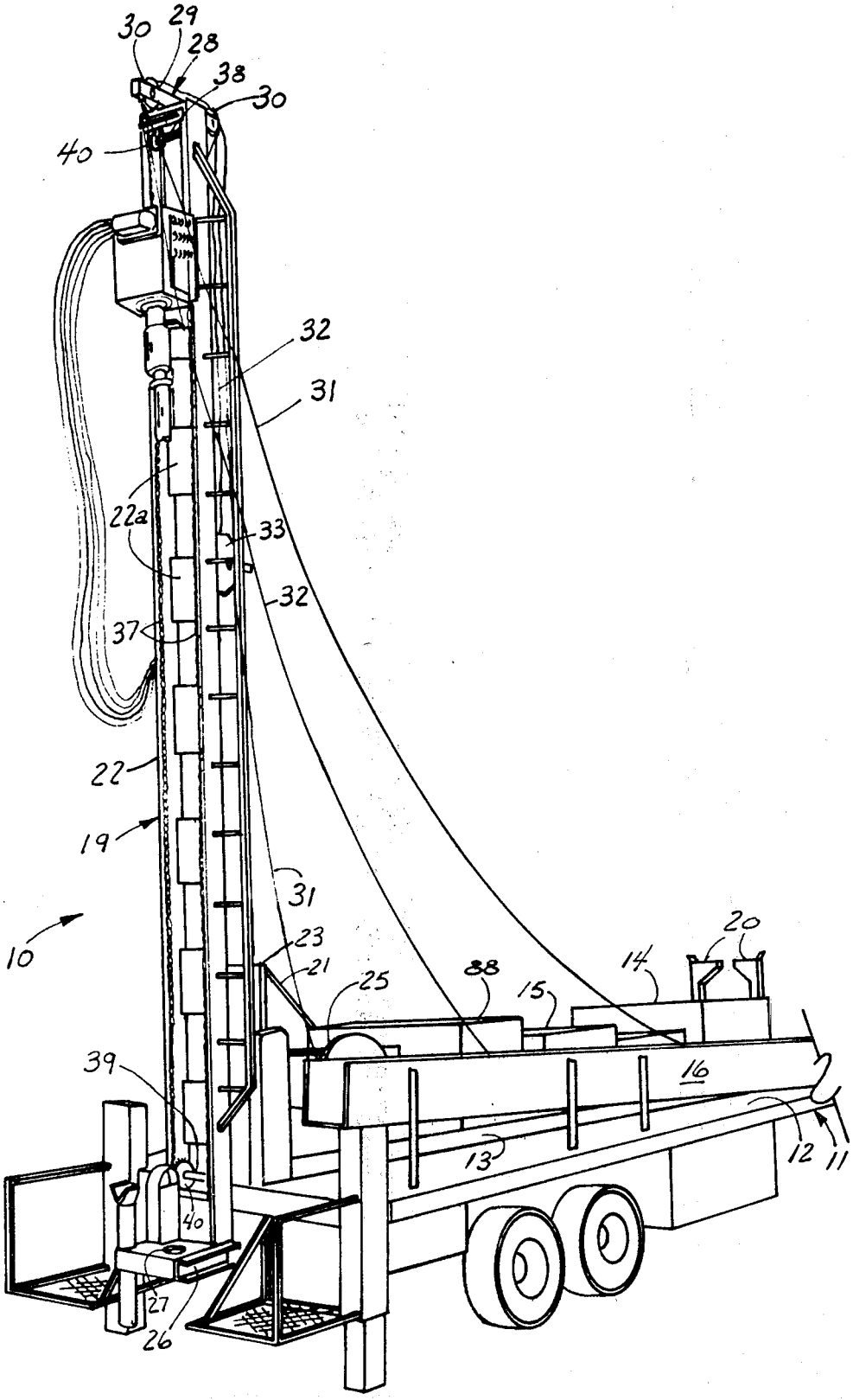
FIG. 1 is a rear perspective view of a preferred embodiment of the rotary drilling device of the present invention that includes a vertically alignable mast on which a drill head assembly is mounted for movement thereon.

The present invention provides a rotary drilling device that is shown generally in FIG. 1 at 10 and is preferably mounted on a truck 11 for portability. Although the drilling device 10 may be employed for a wide variety of soil or rock drilling purposes, it is particularly advantageous for drilling water wells of a substantial depth of over 100 feet.

The truck 11 has a flat bed 12 on which a support frame 13 extending substantially the length of the bed 12 is secured. Mounted toward the front of the support frame 13 are an air compressor 14 and preferably a gasoline or diesel engine 15 that provides the motive force for powering the drilling device 10 through a plurality of hydrostatic transmissions (not shown). Mounted along one longitudinal side of the truck flat bed 12 and canted on a downward slant toward the front is a U-shaped trough 16 for storing sections of drill rod or well casing.

Pivotally secured on the rear of the support frame 13 is a mast assembly 19. For travel of the truck 11, the mast assembly 19 is held in a generally horizontal position extended above the air compressor 14 and engine 15, and is supported in such position by the support frame 13 and a pair of bracket members 20 disposed near the front of the truck bed 12. Upon reaching a work location, the mast assembly 19 is pivoted about the support frame 13 into a vertical position by a pair of hydraulic cylinders 21 pivotally connected at the rod end to the mast assembly 19 and at the cylinder end to the support frame 13. A first winch hoist 25 is also mounted on the support frame 13 adjacent the cylinders 21.

The mast assembly 19 has an elongate body portion 22 preferably of a long rear open throat rectangular box construction, reinforced with shear plates 22*a* and a torsion beam (not shown). A pivot bracket assembly 23 is bolted to the closed front side of the mast assembly 19 and has journal members (not shown) to provide the pivotal connection between the mast assembly 19 and the support frame 13 and also the pivotal connection of the hydraulic cylinders 21 with the mast body portion 22.

Secured to the bottom end of the mast assembly 19 and extended rearwardly therefrom is a rod handling table 26 having a central rod guide portion 27 as is well known in the art. Mounted on the top end of the mast assembly 19 is a sheave assembly 28 having a generally channel shaped sheave support 29 extended outwardly from the front and rear of the assembly 19. Two pairs of sheaves 30 are journaled in both the front and rear outer ends of the sheave support 29 for carrying hoist cables 31 and 32 that are respectively connected to the first hoist winch 25 and a second hoist winch 33 secured on the mast body portion 22.

The mast assembly 19 also includes a chain drive composed of two spaced apart link chains 37 running substantially the length of the mast assembly body portion 22 along each side thereof. An idler shaft 38 and a drive shaft 39 are journaled between the sides of the body portion 22 near the top and bottom ends thereof, respectively, and sprockets 40 about which the chains 37 are trained are disposed on each of the shafts 38 and 39. The drive shaft 39 is connected via an appropriate gear train or chain drive (not shown) to one of the hydrostatic transmissions driven by the engine 15.

Figure 2:
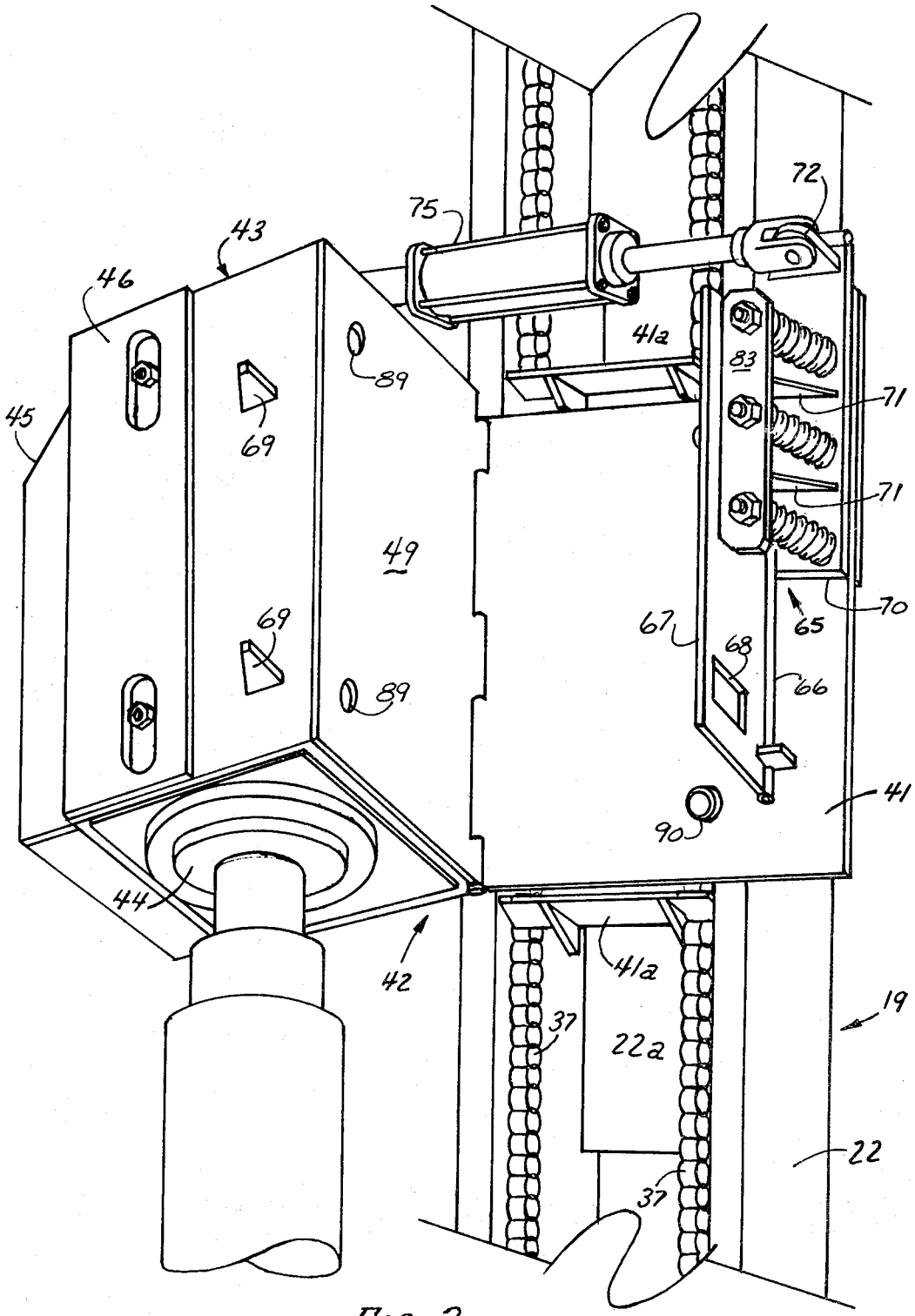
FIG. 2 is an enlarged fragmentary perspective view of the mast of the drilling device of FIG. 1, with the drill head assembly shown in a pivoted non-operating position.
Figure 3:
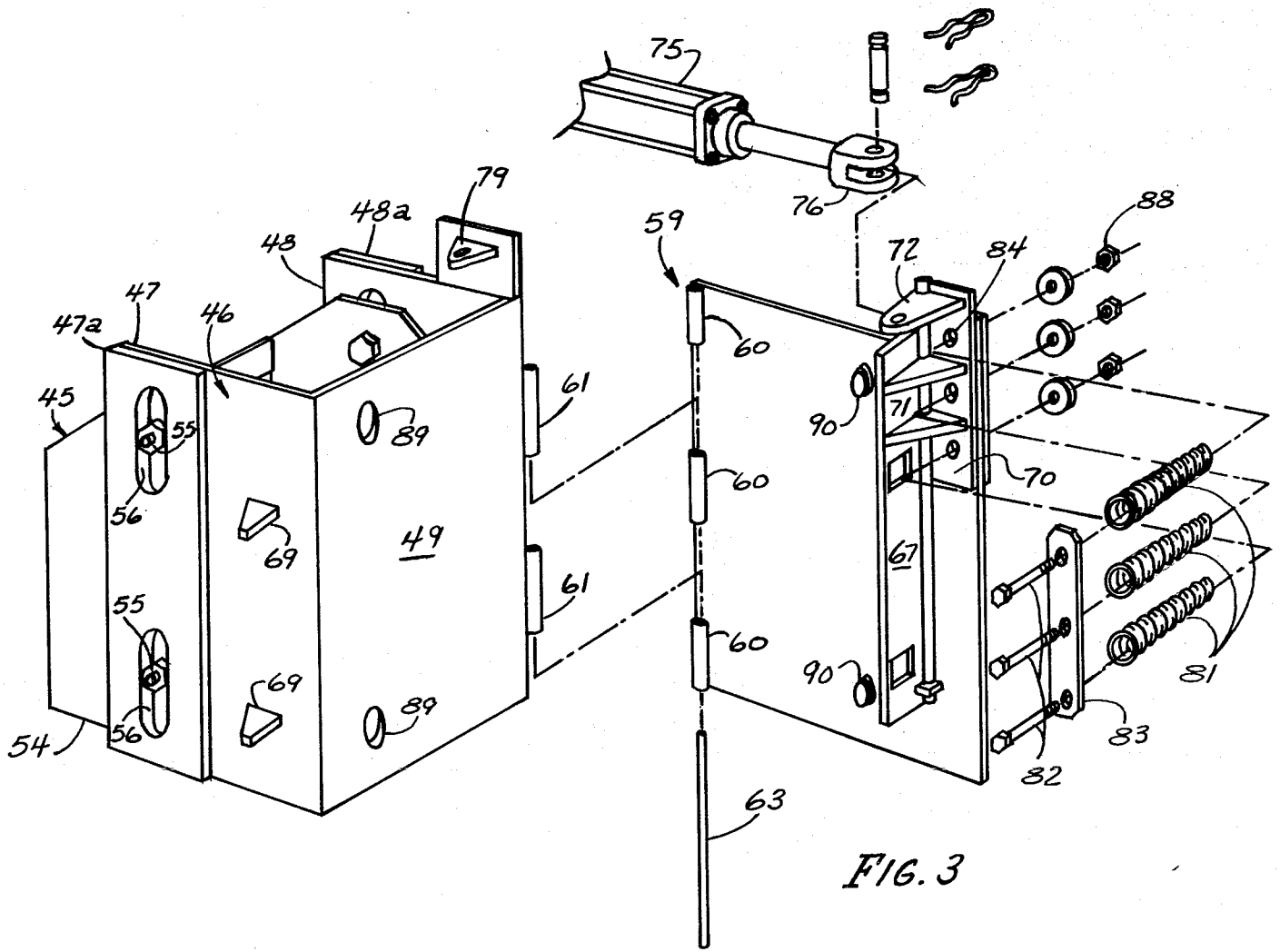
FIG. 3 is an enlarged exploded perspective view of the drill head assembly of FIG. 1 including a hinge plate and a support housing for a rotary drive unit.
Figure 4:
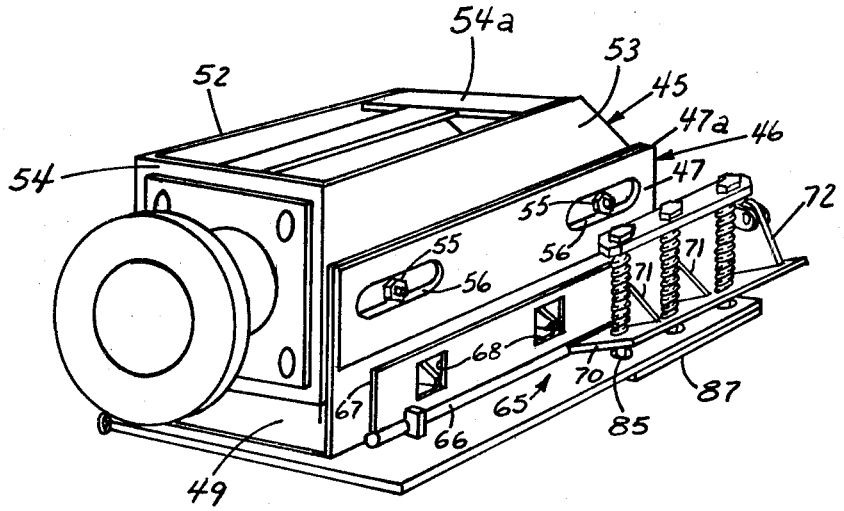
FIG. 4 is an enlarged side perspective view of the drill head assembly of FIG. 1 with the support housing shown held in a non-pivoted operating position by a latch member.
Figure 5:
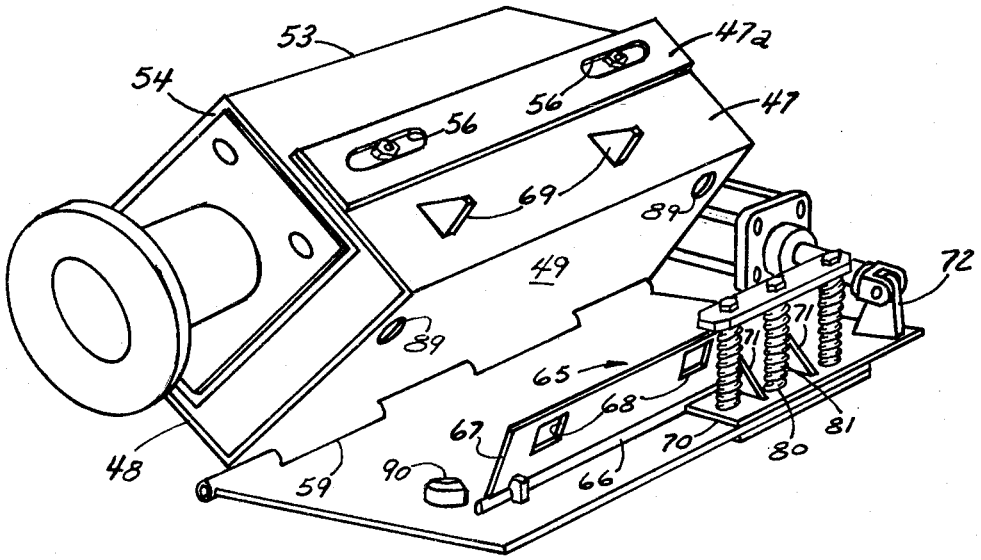
FIG. 5 is an enlarged side perspective view similar to that of FIG. 4, but with the support housing partially pivoted out of said operating position.

As shown most clearly in FIG. 2, a hinge plate 41 is secured to the chains 37 by appropriate bracket means 41*a* and is movable vertically therewith substantially the length of the mast assembly body portion 22. The plate 41 forms part of a drill head assembly 42 and serves as a movable mount for a drive box 43 serving as a support housing for a rotary drive unit 44, also included in the head assembly 42. With reference to FIGS. 3, 4 and 5, the drive box 43 is of a two-piece construction and includes a carriage member 45 and a carriage support member 46 of generally a channel shape with two opposite sidewalls 47 and 48 and a back plate 49 connecting therebetween. The carriage member 45 has genererally an inverted U-shaped configuration with a pair of opposite sidewalls 52 and 53 and a bottom connecting wall 54 and side braces 54*a* (shown only in FIG. 4) therebetween.

The carriage member 45 is adapted to ride in the channel of the support member 46 and is held therein by hubs 55 that protrude from the carriage member sidewalls 52 and 53 to extend into vertically aligned slots 56 in the support member sidewalls 47 and 48 and reinforcing plates 47*a* and 48*a*, respectively, (FIG. 3). Thus, the carriage member 45 has a limited freedom of vertical movement in the support members 46 defined by the length of the slots 56. The rotary drive unit 44 is bolted to the bottom wall 54 of the carriage member 45 in standard fashion for movement therewith.

As shown in FIGS. 3 and 5, the drive box 43 is pivotally connected to the hinge plate 41 by a knuckle type hinge joint 59 formed of vertically spaced apart elongate, interdigited knuckle members 60 and 61 aligned along one side edge of the plate 42 and along one side of the carriage member support sidewall 48, and a connecting pintle 63 disposed through the members 60 and 61.

Thus, the drive box 43 is horizontally pivotable about the hinge joint 59, as shown in FIG. 2, to swing the rotary drive unit 44 out of alignment with the rod handling table 26 and thereby provide an unobstructed hoist winch path for adding drill rod or pipe casing to or removing same from a well being drilled.

Pivoting of drill head assemblies, in general, is old in the art. However, in most cases, drill head pivoting has been employed with drilling equipment having relatively short masts whereby the drill head assembly can be pivoted into and out of an operating position manually by a worker standing on the ground. This, of course, is not possible with a drill head assembly elevated over twenty feet above the ground as in the head assembly 42. Therefore, to manually pivot the drill head assembly 42, a worker would necessarily have to climb the mast assembly 19. For efficient drilling operation, such manual pivoting is highly unsatisfactory. Accordingly, the present invention is directed to providing an automatic means for: (1) normally latching the drive box 43 of the drill head assembly 42 in a normal operating position with the rotary drive unit 44 in alignment with the rod handling table 26, (2) unlatching the drive box 43 for pivotable movement, (3) pivoting the drive box 43 out of the back to the normal operating position, and (4) relatching the drive box 42 in the normal operating position.

Referring again to FIGS. 3, 4 and 5, latching of the drive box 43 of the drill head assembly 42 is provided by a latch assembly 65 that is pivotally mounted on the hinge plate 41 near the side edge opposite that on which the knuckle members 60 are disposed. The latch assembly 65 has an elongated hinge portion 66 pivotally connected to the hinge plate 41 parallel to the vertical axis thereof. A latch plate 67 is preferably welded on the hinge portion 66 in a generally upright relation to the hinge plate and has a pair of longitudinally spaced apart notches 68 near its free edge.

During normal operation of the device 10, the latch plate 67 abuts against the support member sidewall 47, which has a pair of vertically spaced apart hook members 69 that are received in the notches 68 of the plate 67 to form coacting means for locking the drive box 43 in an operating position. A pressure plate 70 is also welded to the hinge portion 66 and is extended generally outwardly toward the adjacent hinge plate side edge on an angle of approximately seventy degrees with respect to the latch plate 67.

Thus, when the latch plate 67 is in substantially a perpendicular relation to the hinge plate 41, the pressure plate 70 is in an oblique relation to the hinge plate 41. Thus, the latch assembly 65 is pivotable in a direction away from the drive box 43 through an arc of approximately twenty degrees until the pressure plate 70 abuts against the hinge plate 41 for a purpose to be described below. A pair of gusset plates 71 are connected to the plates 67 and 70 for reinforcement, and a lever arm 72 is mounted in an outwardly extended relation on the upper end of the pressure plate 70 to extend horizontally outward therefrom.

Figure 6:
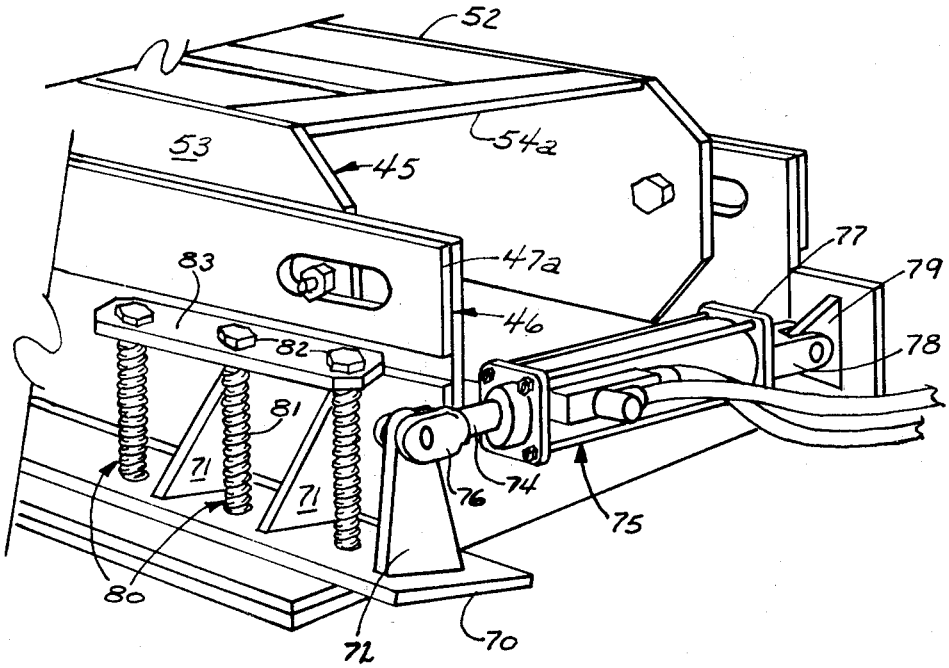
FIG. 6 is an enlarged top perspective view of the drill head assembly of FIG. 4 showing a hydraulic cylinder for pivotally driving the support housing of the head assembly.

Referring to FIG. 6, a piston rod 74 of a hydraulic cylinder 75 is connected via a first clevis connector 76 to the free end of the lever arm 71, and a blind end 77 of the cylinder 75 is connected via a second clevis connection 78 to an ear 79 on an extended portion of the support member sidewall 48. Thus, the hydraulic cylinder 75 extends between the support member 46 and the latch assembly 65 so that when retracted, it secures the latch assembly 65 in a locked condition with respect to the drive box 43 as described above.

Located on the pressure plate 70 are a plurality of vertically spaced apart spring units 80 formed of high pressure coil springs 81 and bolts 82 axially disposed through an abutment bar 83 and springs 81. Preferably, the threaded ends of the bolts 82 are directed through apertures 84 (FIG. 3) in the pressure plate 70, apertures 85 (FIG. 4) in the hinge plate 41 and through a reinforcing plate 87 for securement by nuts 88 (FIG. 3). The springs 81 are substantially compressed to constantly exert a pivoting pressure on the pressure plate 70 in all positions. Consequently, the hydraulic cylinder 75 must overcome the force of the spring units 80 to pivot the latch assembly 65 into a latched relation with the head assembly 42, but during unlatching, as the cylinder 75 is extended, the force of the spring units 80 acts with the cylinder pressure.

Thus, pivoting operation of the drive box 43 is begun when hydraulic fluid is supplied from a reservoir 88 (FIG. 1) on the truck flat bed 12 to the cylinder blind end 77. Initial extension of the cylinder piston rod 74 solely produces pivoting movement of the latch assembly 65 away from the drive box 43 to disengage the latch hooks 69 from the periphery of the notches 68 in the latch plate 67 as the pressure plate 70 engages the hinge plate 41. Thereupon, further extension of the cylinder rod 74 exterts a pivoting force on the drive box 43 which, therefore, begins pivoting about the hinge joint 59 until reaching a fully pivoted position in which it is swung completely to one side of the mast assembly 19.

In such position, the drive box 43 is removed from its normal operating position in line with the rod handling table 26 and the hoist sheaves 30 in order that string rod or pipe casing can be readily added to or removed from a well hole being drilled. Upon completion of rod addition or removal, hydraulic fluid is supplied to the rod end of the cylinder 75, to retract the piston rod 74. At such time, it should be noted that the cylinder 75 no longer exerts an opening pressure on the latch assembly 65, which is held open solely by the force of the spring units 80. Accordingly, the drive box 43 is free to return to its normal operation position without obstruction from the latch plate 67.

The latch assembly 65 is held open until the drive box 43 is completely returned to its normal operating position by retraction of the cylinder 75. Only then does the final retraction of the cylinder 75 exert a closing pivoting force on the latch assembly 65 to pivot the same into latching engagement with the latch hook members 69. It should be noted that to aid in supporting the pivoting drive box 43 on the hinge plate 42, a pair of the support dowels 90 extend outwardly from the plate 42 for insertion into apertures 89 in the back wall 49 of the carriage support member 46.

Although the invention has been described with respect to a preferred embodiment thereof, it is to be understood that it is not to be so limited since changes and modifications can be made therein which are within the full inteded scope of this invention as defined by the appended claims.

I claim:

1. In a rotary drilling device for powering a drill string into subterranean strata and having a supporting main frame, a vertically alignable drill mast mounted from said main frame, a drill string handling means disposed at a lower end of said drill mast, winch means disposed at an upper end of said mast for raising and lowering said drill string, a drill head assembly for applying rotational movement to said drill string, elevational means on which said head assembly is mounted on said mast for vertical movement thereon, and drive means for controlling said elevational means to raise or lower said head assembly on said mast, said head assembly comprising:

(a) a hinge plate connected to said elevational means, (b) a rotary drive unit attachable to one end of said drill string and having rotary power means to drive said drill string;

(c) support means for said drive unit having at least two opposite side walls and a wall connecting therebetween;

(d) coacting hinge means on said hinge plate and said support means to provide for pivotal movement of said support means from an operating position in which said drive unit is in alignment with said string handling means to a pivoted position in which said drive unit is removed from said alignment;

(e) coacting latch means on said hinge plate and said support means to normally maintain said support means in said operating position when in a closed condition and to release said support means when in an open condition;

(f) a single power means for actuating said latch means from a closed condition to an open condition and for pivoting said support means into said pivoted position and returning said support means to said operating position and for returning said latch means to said closed condition; and (g) means for retaining said latch means in an open condition during pivoting movement of said support means.

2. In a rotary drilling device as recited in claim 1, wherein said coacting latch means comprises:

(a) at least one hook member on said support means; and (b) a latch member journaled on said hinge plate and pivotally movable by said power means to engage said hook member.

3. In a rotary drilling device as recited in claim 2, wherein said retaining means includes bias means associated with said latch member to urge said latch member to move to said open condition in all pivotable positions of said latch member.

4. In a rotary drilling device as recited in claim 2, wherein said latch member includes:

(a) a latch plate in a generally upright relation to said hinge plate and having at least one hook receiving aperture engageable with said hook member when said latch means is in a closed condition; and (b) a pressure plate in a fixed relation to said latch plate and extended laterally outwardly therefrom at an oblique angle to said latch plate and said hinge plate.

5. In a rotary drilling device as recited in claim 4 wherein said retaining means includes at least one spring member associated with said pressure plate and said hinge plate to urge said latch member to said open condition.

6. In a rotary drilling device as recited in claim 5 wherein said power means is formed of an extensible and retractable member connected to said latch member and said support means whereby intitial extension of said extensible and retractable member pivots said latch member to an open condition in which said pressure plate abuts against said hinge plate and subsequent extension pivots said support means to said pivoted position.

* * * * *